US009886915B2

(12) United States Patent
Chen

(10) Patent No.: US 9,886,915 B2
(45) Date of Patent: Feb. 6, 2018

(54) DYNAMIC BACKLIGHT ADJUSTMENT METHOD OF DISPLAY SCREEN

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 244 days.

(21) Appl. No.: 14/766,182

(22) PCT Filed: May 19, 2015

(86) PCT No.: PCT/CN2015/079275

§ 371 (c)(1),
(2) Date: Aug. 6, 2015

(87) PCT Pub. No.: WO2016/173009

PCT Pub. Date: Nov. 3, 2016

(65) Prior Publication Data

US 2016/0322006 A1 Nov. 3, 2016

(30) Foreign Application Priority Data

Apr. 29, 2015 (CN) ..... 2015 1 0213886

(51) Int. Cl.
*G09G 3/34* (2006.01)

(52) U.S. Cl.
CPC ... *G09G 3/3426* (2013.01); *G09G 2320/0626* (2013.01); *G09G 2360/16* (2013.01)

(58) Field of Classification Search
CPC ..... G09G 3/3426; G09G 2360/16; G09G 2320/0626
See application file for complete search history.

(56) References Cited

U.S. PATENT DOCUMENTS

2008/0100645 A1* 5/2008 Nitta ..... G09G 3/3426 345/690
2010/0073598 A1* 3/2010 Masuda ..... G09G 3/3426 349/62
2012/0162276 A1* 6/2012 Jang ..... G09G 3/3426 345/690

* cited by examiner

*Primary Examiner* — Aneeta Yodichkas
(74) *Attorney, Agent, or Firm* — Andrew C. Cheng

(57) ABSTRACT

A dynamic backlight adjustment method for a display screen is provided. The method includes a step of dividing a display screen into multiple sub-areas, and executing following steps to one sub-area of the multiple sub-areas: (a) determining a maximum grayscale value of video input signals of the one sub-area when a current frame image is displayed, (b) determining a backlight brightness corresponding to the maximum grayscale value according to a relationship between multiple preset grayscale intervals and multiple backlight brightnesses and (c) adjusting a backlight brightness corresponding to the one sub-area to the backlight brightness corresponding to the maximum grayscale value. Using the dynamic backlight adjustment method, the smoothness in the dynamic backlight adjustment process is better, and the transition of bright and dark of the display screen is more nature.

6 Claims, 5 Drawing Sheets

DYNAMIC BACKLIGHT ADJUSTMENT METHOD OF DISPLAY SCREEN

BACKGROUND OF THE INVENTION

1. Field of the Invention

The present invention relates to a dynamic backlight technology, and more particular to a dynamic backlight adjustment method of a display panel.

2. Description of Related Art

A liquid crystal display (LCD) device has characteristics of a long life, energy saving, low operating voltage, high color rendering index, low temperature operation, fast response, environmental protection and so on. Therefore, the LCD device has generally been applied in various electronic devices (for example, LCD TV or computer). However, a display screen of the LCD device is a passive light emitting device which cannot emit light by itself, so that a backlight source must be disposed to uniformly illuminate the entire screen from the rear surface.

Because the bright and dark degrees for different images displayed on the display screen are different, the bright and dark degrees for different areas of the same image are also different, and the sense of human eye for the bright and dark degrees, that is a brightness, is very sensitive, if displaying an image by the same backlight brightness, the brightness of the image displayed on the display screen will not change significantly. The contrast ratio of the image is lower.

A dynamic backlight technology (local dimming) is used to control a backlight source corresponding to a dark area of the display screen to be turned off, and to control a backlight source corresponding to a bright area of the display screen to be turned on in order to decrease the affection of the contrast ratio caused by a light leakage problem so as to increase the contrast ratio of the displayed image.

However, in the conventional dynamic backlight adjustment method for the display screen, in the adjustment process, the smoothness is not good and the transition of bright and dark of the displayed image is not natural.

SUMMARY OF THE INVENTION

An embodiment of the present invention is to provide a dynamic backlight adjustment method of a display screen in order to solve the problem of not good in the smoothness and not natural in the transition of bright and dark of the displayed image in the adjustment process.

According to an aspect of the embodiment, the present invention provides: a dynamic backlight adjustment method for a display screen, comprising steps of: dividing a display screen into multiple sub-areas, and executing following steps to one sub-area of the multiple sub-areas: (a) determining a maximum grayscale value of video input signals of the one sub-area when a current frame image is displayed; (b) determining a backlight brightness corresponding to the maximum grayscale value according to a relationship between multiple preset grayscale intervals and multiple backlight brightnesses; and (c) adjusting a backlight brightness corresponding to the one sub-area to the backlight brightness corresponding to the maximum grayscale value.

Wherein, the method further comprises: executing step (a), step (b) and step (c) to a portion of the multiple sub-areas or all of the multiple sub-areas except the one sub-area.

Wherein, the step (a) comprises steps of: (a1) detecting a greatest grayscale value of each color component of video input signals of the one sub-area when the current frame image is displayed; (a2) selecting a maximum value of the greatest grayscale values as the maximum grayscale value of video input signals of the one sub-area.

Wherein, the relationship between multiple preset grayscale intervals and multiple backlight brightnesses can be obtained through following steps: (d) performing a brightness uniforming process for a display brightness; (e) using a first backlight brightness to make a backlight source to emit light for the one sub-area; measuring a first actual display brightness of the one sub-area corresponding to the first backlight brightness; calculating and obtaining a first grayscale value corresponding to the first actual display brightness; forming a first grayscale interval by the first grayscale value, wherein, the first grayscale interval only includes the first grayscale value; (f) using a j-th backlight brightness to make the backlight source to emit light for the one sub-area; measuring a j-th actual display brightness of the one sub-area corresponding to the j-th backlight brightness, wherein, j is a natural number and greater than 2; (g) calculating and obtaining a j-th grayscale value corresponding to the j-th actual display brightness; (h) using the j-th grayscale value as an endpoint of a lower bound of a j-th grayscale interval, and using a (j−1)-th grayscale value as an endpoint of an upper bound of the j-th grayscale interval in order to form the j-th grayscale interval, wherein, the upper bound of the j-th grayscale interval is an open interval and the lower bound of the j-th grayscale interval is a closed interval; (i) determining if j equals to m, wherein, m is the number of the backlight brightnesses, and m is a natural number and greater than 2; (j) if j does not equal to m, setting j=j+1 and returning to execute step (f) to step (i); and (k) If j equals to m, obtaining the relationship between multiple backlight brightnesses and multiple grayscale intervals.

Wherein, the step (d) includes: performing the brightness uniforming process for the display brightness to each pixel of the multiple sub-areas or performing the brightness uniforming process for the display brightness to each pixel of the one sub-area.

Wherein, the step of performing the brightness uniforming process for the display brightness to each pixel of the multiple sub-areas comprises: (d1) displaying a preset image on a display screen, and respectively measuring brightness values of pixels of the multiple sub-areas; (d2) calculating an average value of the brightness values of the pixels of the multiple sub-areas; (d3) comparing a brightness value of one pixel of the multiple sub-areas with the average value of the brightness values; (d4) if the brightness value of the one pixel of the multiple sub-areas is greater than the average value of the brightness values, executing a step (d5): lowering a grayscale value of the one pixel such that the brightness value of the one pixel is equal to the average value of the brightness values; and (d6) if the brightness value of the one pixel is not greater than the average value of the brightness values, executing a step (d7): maintaining a grayscale value of the one pixel to be unchanged.

Wherein, the step of performing the brightness uniforming process for the display brightness to each pixel of the one sub-area comprises: (d11) displaying a preset image on a display screen, and respectively measuring a brightness value of each pixel of multiple sub-areas; (d22) respectively determining a minimum brightness value of pixels of each sub-area in the multiple sub-areas; (d33) calculating an average value of the minimum brightness values of pixels of the multiple sub-areas; (d44) comparing a brightness value of one pixel of the one sub-area with the average value of the minimum brightness values; (d55) If the brightness value of the one pixel is greater than the average value of the minimum brightness values, executing a step (d66): lowering a grayscale value of the one pixel such that the brightness value of the one pixel is equal to the average value of the minimum brightness values; and (d77) If the brightness value of the one pixel is not greater than the average value of the minimum brightness values, executing a step (d88): maintaining a grayscale value of the one pixel to be unchanged.

Wherein, the predetermined image is an image that shows a full white color at each pixel of the image.

Wherein, the step of dividing a display screen into multiple sub-areas comprises steps of: determining an effective area of the display screen; and dividing the effective area of the display screen into multiple sub-areas; wherein, the step of determining an effective area of the display screen includes: in a horizontal direction, respectively determining a first edge which is apart from a first horizontal edge of the display screen by a first preset distance, and a second edge which is apart from a second horizontal edge of the display screen by the first preset distance; in a vertical direction, respectively determining a third edge which is apart from a first vertical edge of the display screen by a second preset distance, and a fourth edge which is apart from a second vertical edge of the display screen by the second preset distance; and setting the effective area of the display screen as an area surrounded by the first edge, the second edge, the third edge and the fourth edge.

Wherein, the first preset distance is ranged from $0<d_1<0.1$ W, wherein, $d_1$ is the preset distance, W is a length of the display screen in the vertical direction; the second preset distance is ranged from $0<d_2<0.1$ L, wherein, $d_2$ is the second preset distance, L is a length of the display screen in the horizontal direction.

The above dynamic backlight adjustment method for a display screen, because when determining a relationship between multiple grayscale intervals and multiple backlight brightness, a display brightness corresponding to a sub-area performs a brightness uniforming process such that the smoothness in the dynamic backlight adjustment process is better, and the transition of bright and dark of the display screen is more nature.

DETAILED DESCRIPTION OF THE PREFERRED EMBODIMENT

The following content combines figures and embodiments for detail description of the present invention.

A dynamic backlight adjustment method of a display screen according to an embodiment of the present invention firstly divides the display screen into multiple sub-areas. Then, executing the dynamic backlight adjustment method to each sub-area in the multiple sub-areas. Specifically, firstly, determining an effective area of the display screen. Then, dividing the effective area of the display screen in order to divide the effective area into multiple sub-areas.

Specifically, a step of determining an effective area of the display screen includes: in a horizontal direction, respectively determining a first edge which is apart from a first horizontal edge of the display screen by a first preset distance, and a second edge which is apart from a second horizontal edge of the display screen by the first preset distance. In a vertical direction, respectively determining a third edge which is apart from a first vertical edge of the display screen by a second preset distance, and a fourth edge which is apart from a second vertical edge of the display screen by the second preset distance. Setting the effective area of the display screen as an area surrounded by the first edge, the second edge, the third edge and the fourth edge. Preferably, the first preset distance is ranged from $0<d_1<0.1$ W, wherein, $d_1$ is the preset distance, W is a length of a screen in a vertical direction. The second preset distance is ranged from $0<d_2<0.1$ L, wherein, $d_2$ is the second preset distance, and L is a length of a display screen at a horizontal direction.

Figure 1:
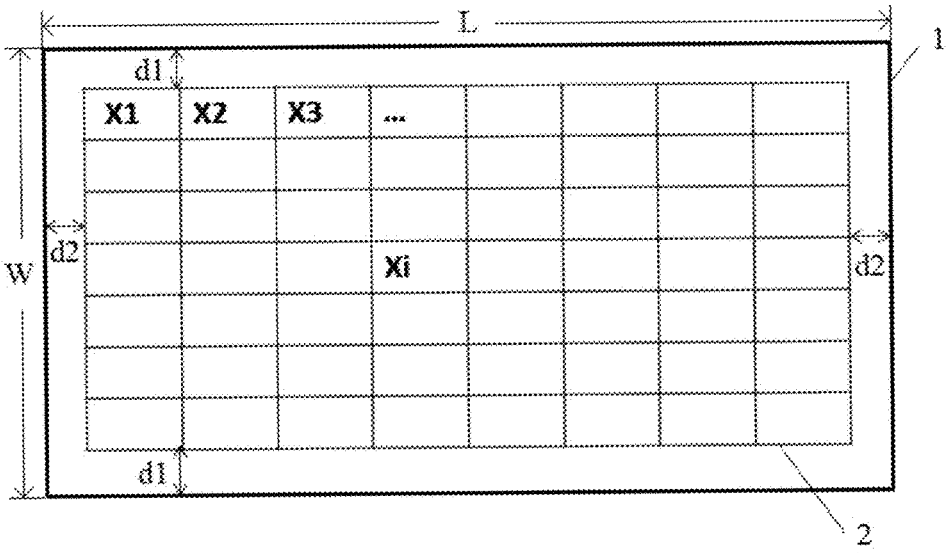
FIG. 1 is a top view of a display screen according to an embodiment of the present invention.

FIG. 1 is a top view of a display screen according to an embodiment of the present invention.

As shown in FIG. 1, numeral "1" is an edge of the display screen, numeral "2" is an effective area of the display screen, wherein, $X_i$ is a i-th sub-area divided from the effective area of the display screen, $1 \leq i \leq n$, n is the number of the sub-areas.

The following paragraphs will describe steps of a dynamic backlight adjustment method for one sub-area of the multiple sub-areas.

Figure 2:
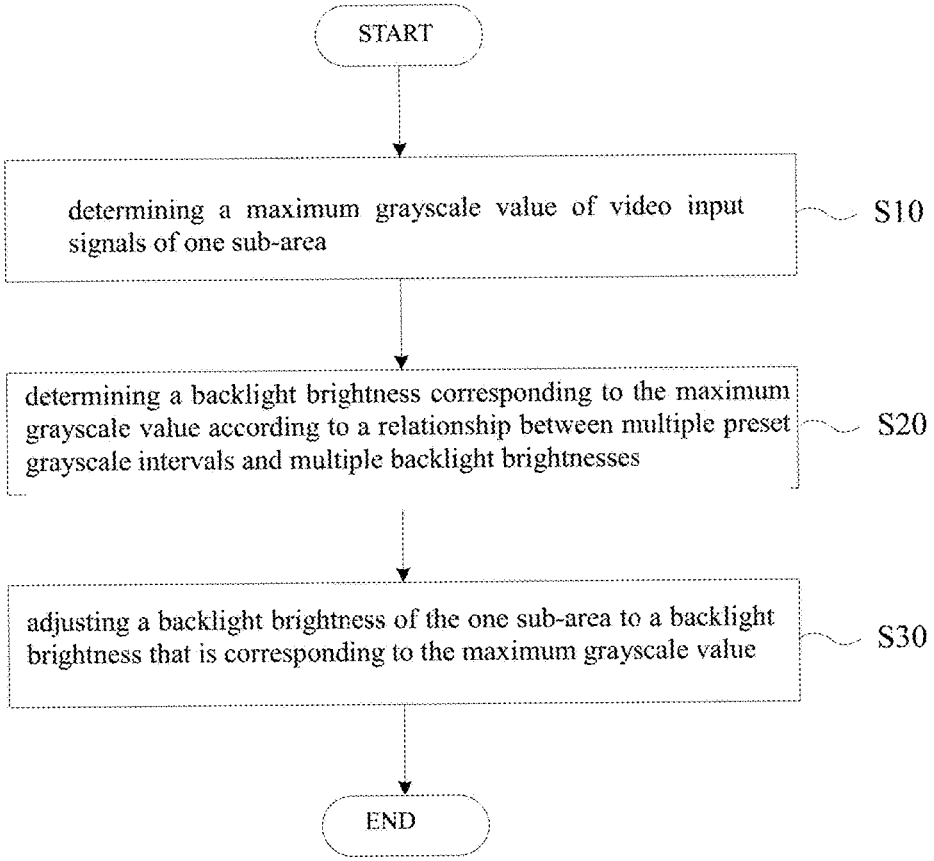
FIG. 2 is a flow chart of a dynamic backlight adjustment method of a display screen according to an embodiment of the present invention.

FIG. 2 is a flow chart of a dynamic backlight adjustment method of a display screen according to an embodiment of the present invention.

With reference to FIG. 2, in a step S10, determining a maximum grayscale value of video input signals of one sub-area when a current frame image is displayed.

Figure 3:
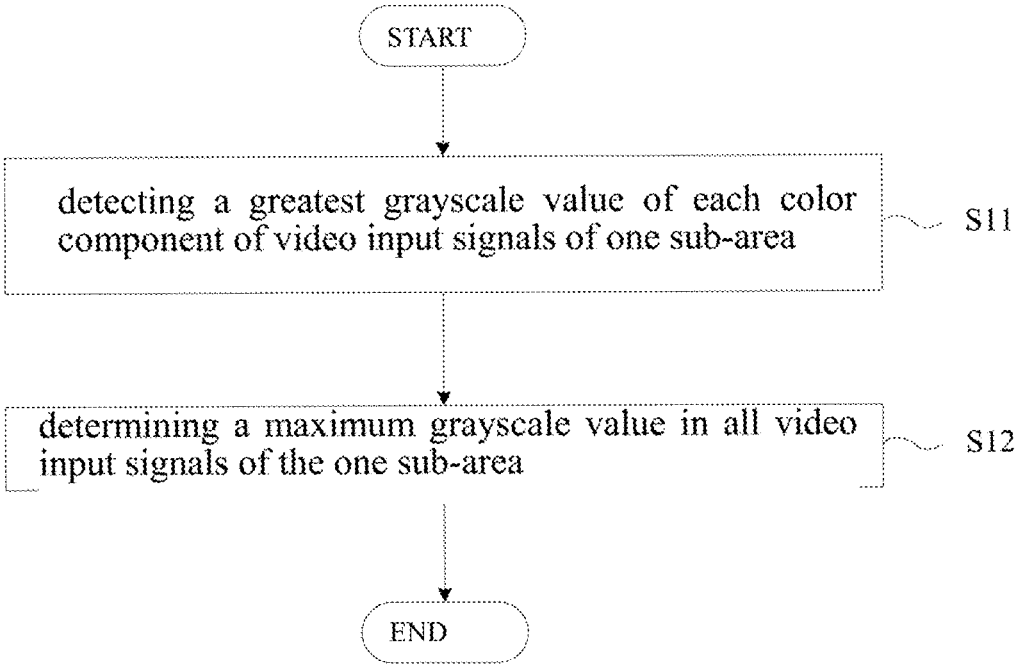
FIG. 3 is a flow chart of a step for determining a maximum grayscale value of video input signals of a sub-area according to an embodiment of the present invention.

FIG. 3 is a flow chart of a step for determining a maximum grayscale value of video input signals of one sub-area according to an embodiment of the present invention.

With reference to FIG. 3, in a step S11, detecting a greatest grayscale value of each color component of video input signals of one sub-area when a current frame image is displayed.

Specifically, when a current frame image is displayed, each pixel of one sub-area has input video signal corresponding to each color component. Therefore, a greatest grayscale value of each color component in all video input signals of the one sub-area can be detected. Preferably, a greatest grayscale value of each color component of R (red color), G (green color) and B (blue) in the input video signals can be detected.

In a step S12, selecting a maximum value of the greatest grayscale values as a maximum grayscale value in all video input signals of the one sub-area.

For example, when the greatest grayscale value of each color component of R (red color), G (green color) and B (blue) in the input video signals has been detected, a following formula can be used to calculate a maximum grayscale value in all video input signals of the one sub-area.

$$Gray_m = \max(R_m, G_m, B_m) \quad (1)$$

In the formula (1), $Gray_m$ is the maximum grayscale value of input video signals of one sub-area, $R_m$ is a greatest grayscale value of red color component of input video signals of the one sub-area, $G_m$ is a greatest grayscale value of green color component of input video signals of the one sub-area, $B_m$ is a greatest grayscale value of blue color component of input video signals of the one sub-area, $\max(R_m, G_m, B_m)$ represents to select a maximum value among $R_m$, $G_m$, $B_m$.

With also reference to FIG. 2, in a step S20, determining a backlight brightness corresponding to the maximum grayscale value according to a relationship between multiple preset grayscale intervals and multiple backlight brightnesses.

Here, the relationship between multiple preset grayscale intervals and multiple backlight brightnesses can be prestored. Once a maximum grayscale value of video input signals of one sub-area is determined when a current frame image is displayed, in step S20, determining a grayscale interval of the multiple grayscale intervals that the maximum grayscale is located in. Then, according to a relationship between the grayscale interval and a backlight brightness, finding a backlight brightness corresponding to the grayscale interval.

In a step S30, adjusting a backlight brightness of the one sub-area to a backlight brightness that is corresponding to the maximum grayscale value.

For example, a sub-area is corresponding to an independent backlight control unit, and the backlight control unit can generate a corresponding backlight control signal according to the backlight brightness corresponding to the maximum grayscale value in order to adjust a backlight brightness of the one sub-area to a backlight brightness that is corresponding to the maximum grayscale value.

The following content will describe a step for determining a relationship between multiple preset grayscale intervals and multiple backlight brightnesses in detail.

Figure 4:
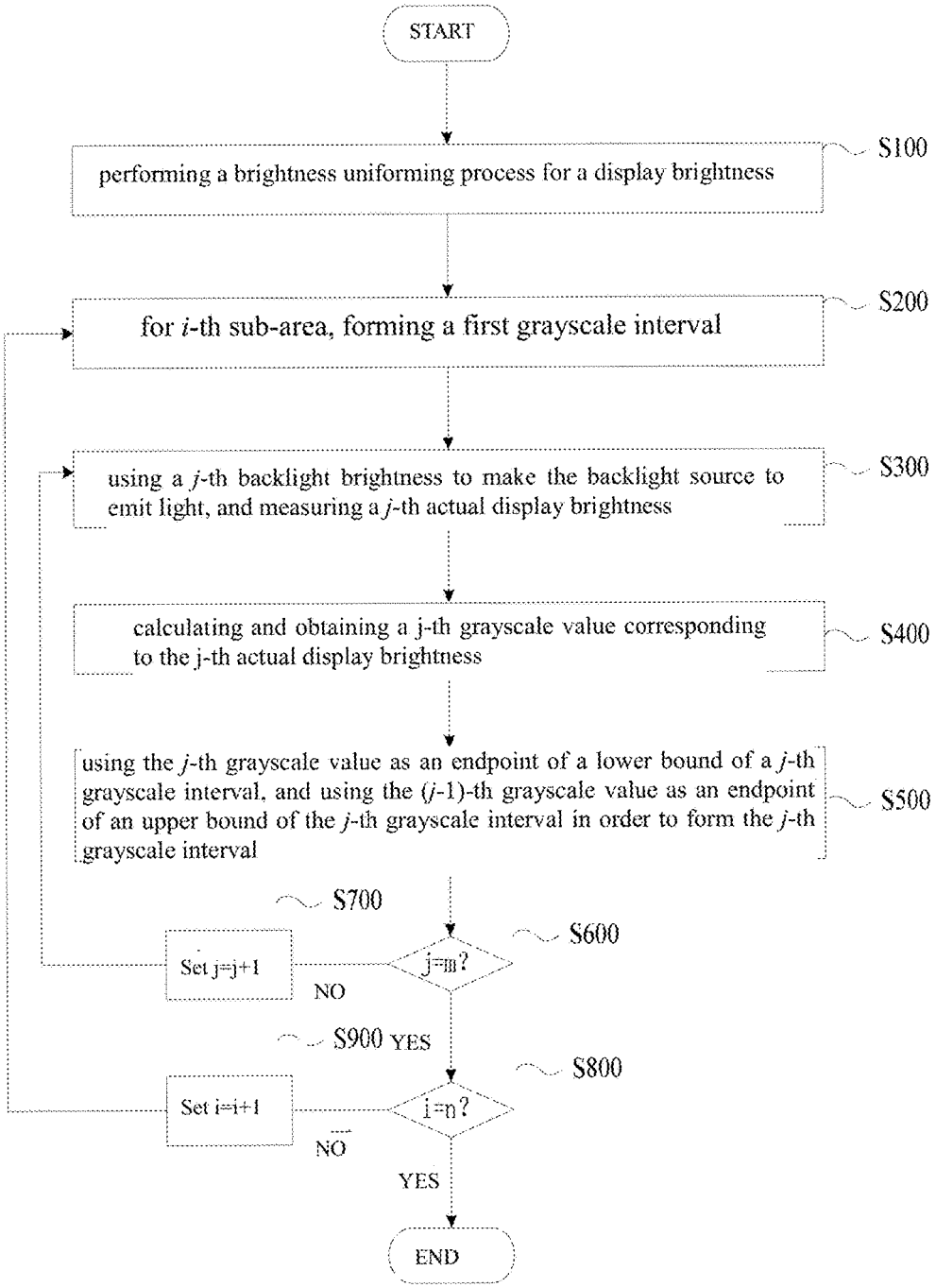
FIG. 4 is a flow chart of a step for determining a relationship between multiple preset grayscale intervals and multiple backlight brightnesses according to an embodiment of the present invention.

FIG. 4 is a flow chart of a step for determining a relationship between multiple preset grayscale intervals and multiple backlight brightnesses.

With reference to FIG. 4, in a step S100, performing a brightness uniforming process for a display brightness.

In an example, performing a brightness uniforming process for a display brightness of each pixel of the multiple sub-areas.

Specifically, in the present embodiment, the multiple sub-areas (that is, the effective area of the display screen) are a target for performing the brightness uniforming process. A brightness value of each pixel corresponding to the effective area is measured, and calculating an average value of the brightness values of the pixels in the effective area. Besides, according to a comparison result of a brightness value of one pixel in the effective area and the average value, performing the brightness uniforming process for the one pixel.

In another embodiment, the brightness uniforming process is performed for the brightness of each pixel of one sub-area.

Specifically, in the present embodiment, one sub-area is a target for performing the brightness uniforming process. Brightness values of all pixels of each sub-area are measured, and determining minimum values of the brightness values of all pixels of the multiple sub-areas, and calculating an average value of the minimum values. Besides, according to a comparison result of the average value of the minimum values and a brightness value of one pixel of one sub-area, performing the brightness uniforming process for the brightness value of the one pixel of the one sub-area.

In step S200, using a first backlight brightness to make a backlight source to emit light for i-th sub-area, measuring a first actual display brightness of i-th sub-area corresponding to the first backlight brightness, and calculating and obtaining a first grayscale value corresponding to the first actual display brightness. Then, forming a first grayscale interval which is calculated from the first grayscale value. Here, the first grayscale interval only includes the first grayscale value.

In step S300, using a j-th backlight brightness to make the backlight source to emit light for i-th sub-area in the multiple sub-areas, and measuring a j-th actual display brightness of i-th sub-area corresponding to the j-th backlight brightness, In step S400, calculating and obtaining a j-th grayscale value corresponding to the j-th actual display brightness.

Preferably, calculating and obtaining the j-th grayscale value corresponding to the j-th actual display brightness according to a current GAMMA value of the display screen. For example, the current GAMMA value is ranged from 1.8~2.5. Preferably, the current GAMMA value is 2.2.

Preferably, a following formula (2) can be used to calculate and measure j-th grayscale value corresponding to j-th actual display brightness, $$Gray[Lv(j)] = 255 \cdot \left(\frac{Lv(j)}{Lv(m)}\right)^{1/a} \quad (2)$$

In formula (2), Gray[Lv(j)] is the j-th grayscale value corresponding to j-th actual display brightness, Lv(j) the j-th actual display brightness, Lv(m) is m-th actual display brightness, a is the current GAMMA value of the display screen. Here, $2 \le j \le m$, m is the number of the backlight brightnesses, and m is a natural number which is greater than or equal to 2, preferably, $2 \le m \le 32$. Here, the formula (2) can be used to calculate the first grayscale value corresponding to the first actual display brightness in step S200.

In the step S500, using the j-th grayscale value as an endpoint of a lower bound of a j-th grayscale interval, and using the (j−1)-th grayscale value as an endpoint of an upper bound of the j-th grayscale interval in order to form the j-th grayscale interval. Here, the upper bound of the j-th grayscale interval is an open interval and the lower bound of the j-th grayscale interval is a closed interval. Here, the number of the grayscale intervals and the number of the backlight brightnesses are the same. That is, the number of the grayscale intervals is also m.

In a step S600, determining if j equals to m.

If j does not equal to m, executing a step S700: setting j=j+1, and returning to execute a step S300.

If j equals to m, a relationship between multiple backlight brightnesses and multiple grayscale intervals for i-th sub-area is obtained, and continuing to execute a step S800: determining if i equals to n.

If i does not equal to n, executing a step S900: setting i=i+1, and returning to execute a step S200.

If i equals to n, a relationship between multiple backlight brightnesses and multiple grayscale intervals for the multiple sub-areas is obtained.

In the present embodiment, referring a following Table 1 to form multiple grayscale intervals by multiple grayscale values:

| Serial number | Grayscale value | Grayscale interval |
|---|---|---|
| 1 | $Gray[Lv(1)] = 255 \cdot \left(\frac{Lv(1)}{Lv(m)}\right)^{1/a}$ | Gray[Lv(1)] |
| 2 | $Gray[Lv(2)] = 255 \cdot \left(\frac{Lv(2)}{Lv(m)}\right)^{1/a}$ | (Gray[Lv(1)], Gray[Lv(2)]] |
| 3 | $Gray[Lv(3)] = 255 \cdot \left(\frac{Lv(3)}{Lv(m)}\right)^{1/a}$ | (Gray[Lv(2)], Gray[Lv(3)]] |
| . . . | . . . | . . . |
| m | $Gray[Lv(m)] = 255 \cdot \left(\frac{Lv(m)}{Lv(m)}\right)^{1/a}$ | (Gray[Lv(m − 1)], Gray[Lv(m)]] |

The forms of the grayscale intervals shown in Table. 1 are only an embodiment. For example, for the grayscale interval corresponding to serial number 2, the grayscale interval can also be denoted as [Gray[Lv(1)]+1, Gray[Lv(2)]].

The following will introduce a step for performing a brightness uniforming process for a display brightness to each pixel of the multiple sub-areas.

Figure 5:
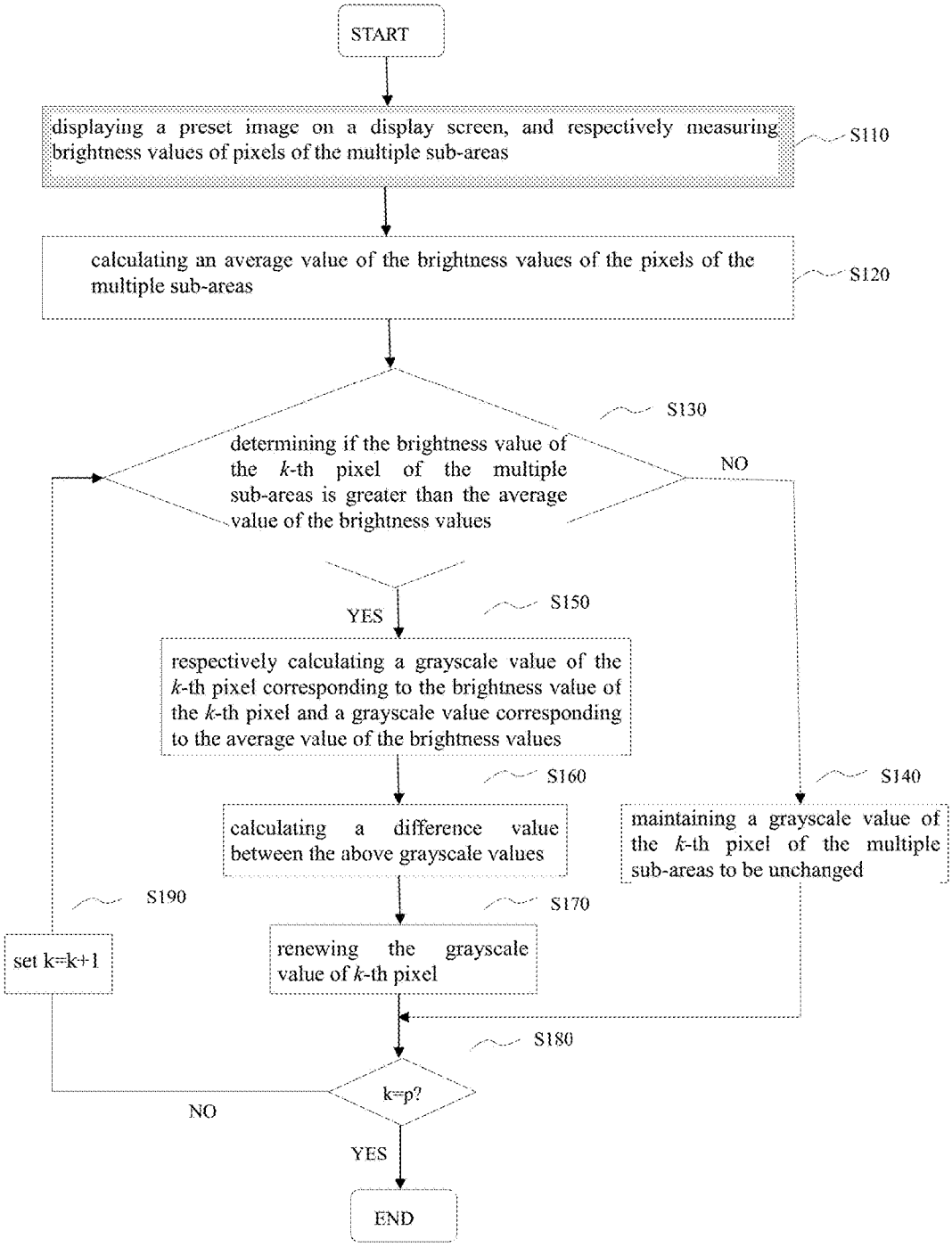
FIG. 5 is a flow chart of a step for performing a brightness uniforming process to each pixel of multiple sub-areas according to an embodiment of the present invention.

FIG. 5 is a flow chart of a step for uniforming display brightness of each pixel of multiple sub-areas according to an embodiment of the present invention. With reference to FIG. 5, in a step S110, displaying a preset image on a display screen, and respectively measuring brightness values of pixels of the multiple sub-areas. Preferably, the preset image can be an image showing a full white color at each pixel. At this time, a grayscale value of each pixel is 255. For example, a CCD (Charge-Coupled Device) can be used to measure the brightness value of each pixel of the multiple sub-areas.

In a step S120, calculating an average value of the brightness values of the pixels of the multiple sub-areas.

Preferably, a following formula (3) can be used for calculating the average value of the brightness values of the pixels of the multiple sub-areas, $$\overline{S'} = \frac{\sum_{k=1}^{p} S_k}{p} \tag{3}$$

In the formula (3), $\overline{S'}$ denotes the average value of the brightness values of the pixels of the multiple sub-areas, $S_k$ denotes a brightness value of a k-th pixel of the multiple sub-areas, $1 \le k \le p$, p denotes the number of all pixels of the multiple sub-areas.

In a step S130, comparing the brightness value of the k-th pixel of the multiple sub-areas with the average value of the brightness values. That is, determining if the brightness value of the k-th pixel of the multiple sub-areas is greater than the average value of the brightness values.

If the brightness value of the k-th pixel of the multiple sub-areas is not greater than (i.e., less than or equal to) the average value of the brightness values, executing a step S140: maintaining a grayscale value of the k-th pixel of the multiple sub-areas to be unchanged. For example, when the preset image is an image showing a full white color at each pixel, the grayscale value of the k-th pixel of the multiple sub-areas is still 255 (that is, in a video input signal of the k-th pixel, the grayscale value of each R, G and B color component is still 255.

If the brightness value of the k-th pixel of the multiple sub-areas is greater than the average value of the brightness values, executing a step S150: respectively calculating a grayscale value of the k-th pixel corresponding to the brightness value of the k-th pixel and a grayscale value corresponding to the average value of the brightness values. Here, method for calculating a grayscale value of one pixel corresponding to a brightness value of the one pixel is a common knowledge in the present technology field, no more repeating here.

In a step S160, calculating a difference value between a grayscale value of k-th pixel and a grayscale value corresponding to the average value of the brightness value.

In a step S170, subtracting the difference value from the grayscale value of the k-th pixel in order to renew the grayscale value of k-th pixel, and displaying the k-th pixel by the renewed grayscale value such that the brightness value of the k-th pixel is equal to the average value of the brightness value.

For example, when the preset image is an image showing a full white color at each pixel, the grayscale value of the k-th pixel is lowered by the difference value in order to renew the grayscale value of the k-th pixel. Through looking a white balance table, a grayscale value of each color component corresponding to the renewed grayscale value of the pixel can be obtained. Then, controlling the pixel to be displayed according to the grayscale value of each color component corresponding to the renewed grayscale value of the pixel such that the brightness value of the pixel is equal to the average value of the brightness value. Here, the white-balance table is a common knowledge known by the person of ordinary skill in the art, no more detail description.

In a step S180, determining if k equals to p, wherein, p is a natural number which is greater than or equal to 1.

If k does not equal to p, executing a step S190: setting k=k+1, and returning to execute a step S130.

If k equals to p, the step of brightness uniforming process for a display brightness of each pixel of the multiple sub-areas is finished. Here, after finishing the step of brightness uniforming process for a display brightness, a display brightness of each pixel of the multiple sub-areas is close to (that is, less than or equal to) the average value of the brightness values.

Figure 6:
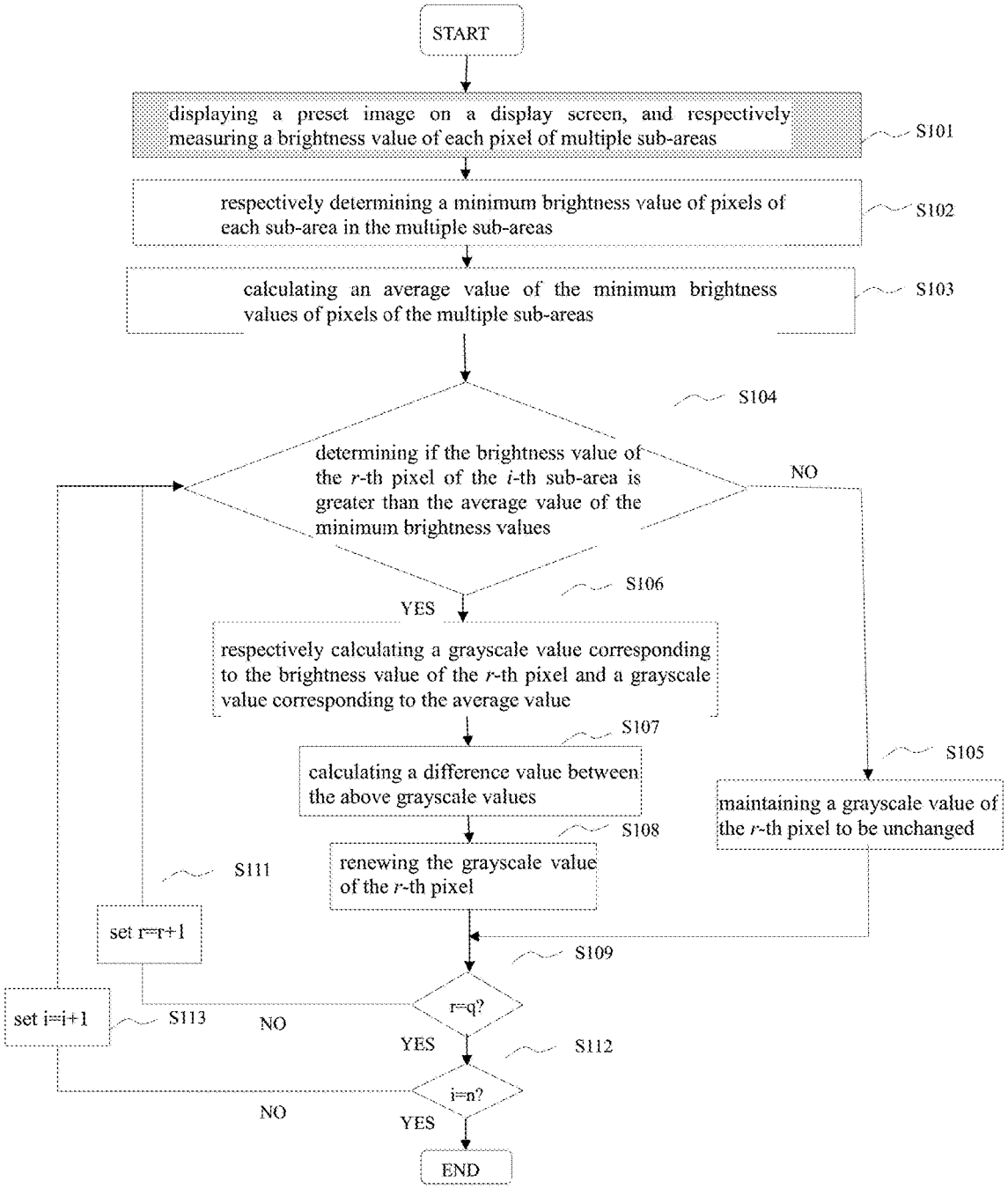
FIG. 6 is a flow chart of a step for performing a brightness uniforming process to each pixel of one sub-area according to an embodiment of the present invention.

With reference to FIG. 6 for detail description of performing a brightness uniforming process to each pixel of one sub-area.

FIG. 6 is a flow chart of a step for performing a brightness uniforming process to each pixel of one sub-area according to an embodiment of the present invention.

With reference to FIG. 6, in a step S101, displaying a preset image on a display screen, and respectively measuring a brightness value of each pixel of multiple sub-areas. Preferably, the preset image can be an image showing a full white color at each pixel. At this time, a grayscale value of each pixel is 255. For example, a CCD (Charge-Coupled Device) can be used to measure the brightness value of each pixel of the multiple sub-areas.

In a step 102, respectively determining a minimum brightness value of pixels of each sub-area in the multiple sub-areas so as to obtain multiple minimum brightness values.

In a step S103, calculating an average value of the minimum brightness values of pixels of the multiple sub-areas.

Preferably, a following formula (4) can be used to calculate the average value of the minimum brightness values of pixels of the multiple sub-areas, $$\bar{S} = \frac{\sum_{i=1}^{n} S_i}{n} \tag{4}$$

In the formula (4), $\bar{S}$ denotes the average value of the minimum brightness values of pixels of the multiple sub-areas, $S_i$ is the minimum brightness value of the pixels of the i-th sub-area.

In a step S104, comparing a brightness value of an r-th pixel of the i-th sub-area with the average value of the minimum brightness values. That is, determining if the brightness value of the r-th pixel of the i-th sub-area is greater than the average value of the minimum brightness values.

If the brightness value of the r-th pixel is not greater than (i.e., less than or equal to) the average value of the minimum brightness values, executing a step S105: maintaining a grayscale value of the r-th pixel to be unchanged. For example, when the preset image is an image showing a full white color at each pixel, the grayscale value of the r-th pixel is still 255 (that is, in a video input signal of the i-th pixel, the grayscale value of each R, G and B color component is still 255.

If the brightness value of the r-th pixel is greater than the average value of the minimum brightness values, executing a step S106: respectively calculating a grayscale value of the r-th pixel corresponding to the brightness value of the r-th pixel and a grayscale value corresponding to the average value of the minimum brightness values.

In a step S107: calculating a difference value between the grayscale value of r-th pixel and the grayscale value corresponding to the average value of the minimum brightness values.

In a step S108, subtracting the difference value from the grayscale value of the r-th pixel in order to renew the grayscale value of the r-th pixel, and displaying the r-th pixel by the renewed grayscale value such that the brightness value of the r-th pixel is equal to the average value of the minimum brightness values.

For example, when the preset image is an image showing a full white color at each pixel, the grayscale value of the r-th pixel is lowered by the difference value in order to renew the grayscale value of the r-th pixel. Through looking a white-balance table, a grayscale value of each color component corresponding to the renewed grayscale value of the pixel can be obtained. Then, controlling the pixel to be displayed according to the grayscale value of each color component corresponding to the renewed grayscale value of the pixel such that the brightness value of the pixel is equal to the average value of the minimum brightness values. Here, the white-balance table is a common knowledge known by the person of ordinary skill in the art, no more detail description.

In a step S109, determining if r equals to q, wherein q is a total number of pixels in the i-th sub-area, and q is a natural number which is greater than or equal to 1.

If r does not equal to q, executing a step S111: setting r=r+1, and returning to execute a step S104.

If r equals to q, the step of brightness uniforming process for a display brightness to each pixel of the i-th sub-area is finished. If the above step of brightness uniforming process is required for a portion of the multiple sub-areas or all of the multiple sub-areas except the i-th sub-area, continuing to execute a step S112: determining if i equals to n.

If i does not equal to n, executing a step 113: setting i=i+1, and returning to execute a step S104.

If i equals to n, the step of brightness uniforming process for a display brightness to each pixel of the multiple sub-areas is finished. Here, after finishing the step of brightness uniforming process for a display brightness, a display brightness of each pixel of the multiple sub-areas is close to (that is, less than or equal to) the average value of the brightness value.

The above dynamic backlight adjustment method for a display screen, because when determining a relationship between multiple grayscale intervals and multiple backlight brightness, a display brightness corresponding to a sub-area performs a brightness uniforming process such that the smoothness in the dynamic backlight adjustment process is better, and the transition of bright and dark of the display screen is more nature.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A dynamic backlight adjustment method for a display screen, comprising steps of:

dividing a display screen into multiple sub-areas wherein each sub-area has multiple pixels, and executing following steps to one sub-area of the multiple sub-areas:

(a) determining a maximum grayscale value of video input signals of the one sub-area when a current frame image is displayed;

(b) determining a backlight brightness corresponding to the maximum grayscale value according to a relationship between multiple preset grayscale intervals and multiple backlight brightnesses of a backlight source, wherein, the relationship between multiple preset grayscale intervals and multiple backlight brightnesses of a backlight source is obtained by multiple steps including a step (d) performing a brightness uniforming process for a display brightness of each pixel of the multiple sub-areas, wherein the step (d) includes steps of (d1) displaying a preset image that shows a full white color at each pixel on the display screen, and respectively measuring a brightness value of each pixel of the multiple sub-areas through a Charge-Coupled Device (CCD);

(d2) calculating an average value of the brightness values;

(d3) comparing a brightness value of one pixel of the multiple sub-areas with the average value of the brightness values;

(d4) if the brightness value of the one pixel of the multiple sub-areas is greater than the average value of the brightness values, executing a step (d5): lowering a grayscale value of the one pixel such that the brightness value of the one pixel is equal to the average value of the brightness values; and (d6) if the brightness value of the one pixel is not greater than the average value of the brightness values, executing a step (d7): maintaining a grayscale value of the one pixel to be unchanged wherein, after finishing the step (d), the display brightness of each pixel of the multiple sub-areas is less than or equal to the average value of the brightness value; and (c) adjusting a backlight brightness corresponding to the one sub-area to the backlight brightness corresponding to the maximum grayscale value.

2. The dynamic backlight adjustment method according to claim 1, wherein, the method further comprises: executing step (a), step (b) and step (c) to a portion of the multiple sub-areas or all of the multiple sub-areas except the one sub-area.

3. The dynamic backlight adjustment method according to claim 1, wherein, the step (a) comprises steps of:

(a1) detecting a greatest grayscale value of each color component of video input signals of the one sub-area when the current frame image is displayed; and (a2) selecting a maximum value of the greatest grayscale values as the maximum grayscale value of video input signals of the one sub-area.

4. The dynamic backlight adjustment method according to claim 1, wherein, the relationship between multiple preset grayscale intervals and multiple backlight brightnesses is obtained through following steps after the step (d):

(e) using a first backlight brightness to make a backlight source to emit light for the one sub-area; measuring a first actual display brightness of the one sub-area corresponding to the first backlight brightness; calculating and obtaining a first grayscale value corresponding to the first actual display brightness; forming a first grayscale interval by the first grayscale value, wherein, the first grayscale interval only includes the first grayscale value;

(f) using a j-th backlight brightness to make the backlight source to emit light for the one sub-area; measuring a j-th actual display brightness of the one sub-area corresponding to the j-th backlight brightness, wherein, j is a natural number and greater than 2;

(g) calculating and obtaining a j-th grayscale value corresponding to the j-th actual display brightness according to a current GAMMA value of the display screen;

(h) using the j-th grayscale value as a lower endpoint of a j-th grayscale interval, and using a (j−1)-th grayscale value as an upper endpoint of the j-th grayscale interval in order to form the j-th grayscale interval;

(i) determining if j equals to m, wherein, m is the number of the backlight brightnesses, and m is a natural number and greater than 2;

(j) if j does not equal to m, setting j=j+1 and returning to execute step (f) to step (i); and (k) if j equals to m, obtaining the relationship between multiple backlight brightnesses and multiple grayscale intervals.

5. The dynamic backlight adjustment method according to claim 1, wherein, the step of dividing a display screen into multiple sub-areas comprises steps of:

determining an effective area of the display screen; and dividing the effective area of the display screen into multiple sub-areas;

wherein, the step of determining an effective area of the display screen includes:

in a horizontal direction, respectively determining a first edge which is apart from a first horizontal edge of the display screen by a first preset distance, and a second edge which is apart from a second horizontal edge of the display screen by the first preset distance;

in a vertical direction, respectively determining a third edge which is apart from a first vertical edge of the display screen by a second preset distance, and a fourth edge which is apart from a second vertical edge of the display screen by the second preset distance; and setting the effective area of the display screen as an area surrounded by the first edge, the second edge, the third edge and the fourth edge.

6. The dynamic backlight adjustment method according to claim 5, wherein, the first preset distance is ranged from $0<d1<0.1\ W$, wherein, d1 is the preset distance, W is a length of the display screen in the vertical direction; the second preset distance is ranged from $0<d2<0.1\ L$, wherein, d2 is the second preset distance, L is a length of the display screen in the horizontal direction.

* * * * *